US005816322A

United States Patent [19]

Albano et al.

[11] Patent Number: 5,816,322

[45] Date of Patent: Oct. 6, 1998

[54] QUENCH COOLER

[75] Inventors: John Vincent Albano, Oradell; Kandasamy Meenakshi Sundaram, West Patterson, both of N.J.; Hellmut Adam Herrmann, Kassel, Germany

[73] Assignees: ABB Lummus Global Inc., Bloomfield, N.J.; SHG - Schack GmbH, Kassel-Bettenhausen, Germany

[21] Appl. No.: 844,269

[22] Filed: Apr. 18, 1997

[51] Int. Cl.[6] ..... F28F 9/02

[52] U.S. Cl. ..... 165/173; 165/134.1; 165/154

[58] Field of Search ..... 165/134.1, 158, 165/173, 174

[56] References Cited

U.S. PATENT DOCUMENTS 4,097,544 6/1978 Hengstebeck ..... 260/683 R 5,029,637 7/1991 Brucher et al. ..... 165/119

5,464,057 11/1995 Albano et al. ..... 165/173

FOREIGN PATENT DOCUMENTS 1129588 10/1968 United Kingdom ..... 165/134.1

*Primary Examiner*—Allen J. Flanigan

*Attorney, Agent, or Firm*—Alix, Yale & Ristas, LLP

[57] ABSTRACT

A quench cooler or transferline heat exchanger for quenching the effluent from a thermal cracking furnace has an inlet connector between the cracking furnace tubes and the tubes of the quench cooler. The tubes of the quench cooler are arranged in a circular pattern of spaced tubes. The flow passage of the connector is configured to initially decelerate and then re-accelerate the gas. This involves a conical diverging diffuser followed by a radial diffuser and then an annular converging section. The cross sectional transitions are smooth to avoid dead spaces and minimize pressure loss.

3 Claims, 4 Drawing Sheets

QUENCH COOLER

BACKGROUND OF THE INVENTION

This invention relates to a novel heat exchanger or quench cooler for quenching the effluent from a hydrocarbon cracking furnace. More particularly, the invention relates to the coupling between the cracking furnace tubes and the tubes of the quench cooler or transferline exchanger.

In the production of light olefins (ethylene, propylene, butadiene and butylenes) and associated aromatics (benzene, toluene, ethylbenzene, xylenes and styrene) by the thermal cracking of hydrocarbon feedstocks in the presence of steam, the cracking reactions are stopped by rapidly cooling or quenching the cracking furnace effluent. The quenching time is measured in milliseconds and has the purpose of "freezing" the furnace outlet composition at its momentary value to prevent degradation of the olefin yield through continuing secondary reactions. A number of different quench cooler designs are available in the marketplace depending upon the quantity of cracked gas to be cooled, the fouling tendencies of the furnace effluent and the pressure/temperature conditions of the steam to be generated. These designs range from conventional fixed tubesheet shell and tube heat exchangers to double pipe designs.

It is well known that for any given cracking furnace operating conditions, the yield of olefins can be maximized and quencher fouling minimized by decreasing the temperature of the gas leaving the cracking furnace as rapidly as possible. This requires that the quench cooler be positioned as close as possible to the cracking furnace outlet, that the volume of the inlet section of the quench cooler be minimized and that the surface to volume ratio in the cooling section be maximized. The latter requirement implies that a multiplicity of small quencher tubes are more favorable than a single large diameter arrangement.

One prior art type of quench cooler known as the SHG transferline exchanger (Schmidt'sche Heissdampf—Gesellschaft mbH) uses a multiplicity of double tube arrangements in parallel wherein each quench tube is surrounded by a concentric outer tube which carries the water-steam mixture. The annuli between the inner and outer tubes are supplied with boiler water through horizontal, oval-shaped headers. In this regard, see German Patentschrift DE 2551195. Another prior art patent which uses this double tube arrangement with an oval header for the outside tubes is U.S. Pat. No. 4,457,364. This patent discloses a distributor having an inlet for the gas from the furnace and two or three diverging branches forming a wye or tri-piece for the transition between the furnace and the quench cooler. As indicated, this transition where cooling has not yet begun can be critical in minimizing continued reaction and undesirable coke deposits. In this U.S. Pat. No. 4,457,364, the cross sectional area for flow through the connector is substantially uniform to achieve substantially constant gas velocity throughout the distributor. The distributor may also be divergent in cross sectional area up to the point where the ratio of the sum of the cross sectional areas of the branches to the cross sectional area of the inlet is 2:1.

In U.S. Pat. No. 5,464,057, the inlet section or connector for a quench cooler between the furnace outlet and the inlets to the quench cooler tubes splits the flow into a plurality of branches and is designed to reduce the inlet section residence time to a minimum. In order to uniformly distribute the gas to a plurality of in-line arranged quench tubes, the flow passages are configured to first efficiently decelerate the gas leaving the furnace and then re-accelerate the gas to the quencher cooling tube velocity. A conical diverging diffuser section in the connector decelerates the gases and then a tapered and branched converging section re-accelerates the gases as they are fed into the quench cooler tubes. The cross sectional transitions are smooth with monotonic area change in the flow direction (aerodynamic) so that dynamic pressure is recovered, dead spaces, i.e. zones of flow separation, are avoided and the pressure loss is minimal. Although such a connector is very effective, it is only adaptable to an in-line arrangement of quench tubes.

SUMMARY OF THE INVENTION

The present invention relates to the inlet section or connector for a quench cooler between the furnace outlet and the inlets to the quench cooler tubes. The quench cooler makes use of the double tube arrangement with an oval header for the outside tubes and with the plurality of quench tubes being arranged in a circular fashion. The connector provides a conical diffuser channel which decelerates the gases leaving the furnace and then provides a radial diffuser to direct the gases outwardly. The connector then provides for the smooth re-acceleration of the gases into the circular arrangement of cooling tubes at the working tube velocity.

DESCRIPTION OF THE PREFERRED EMBODIMENT

Figure 1:
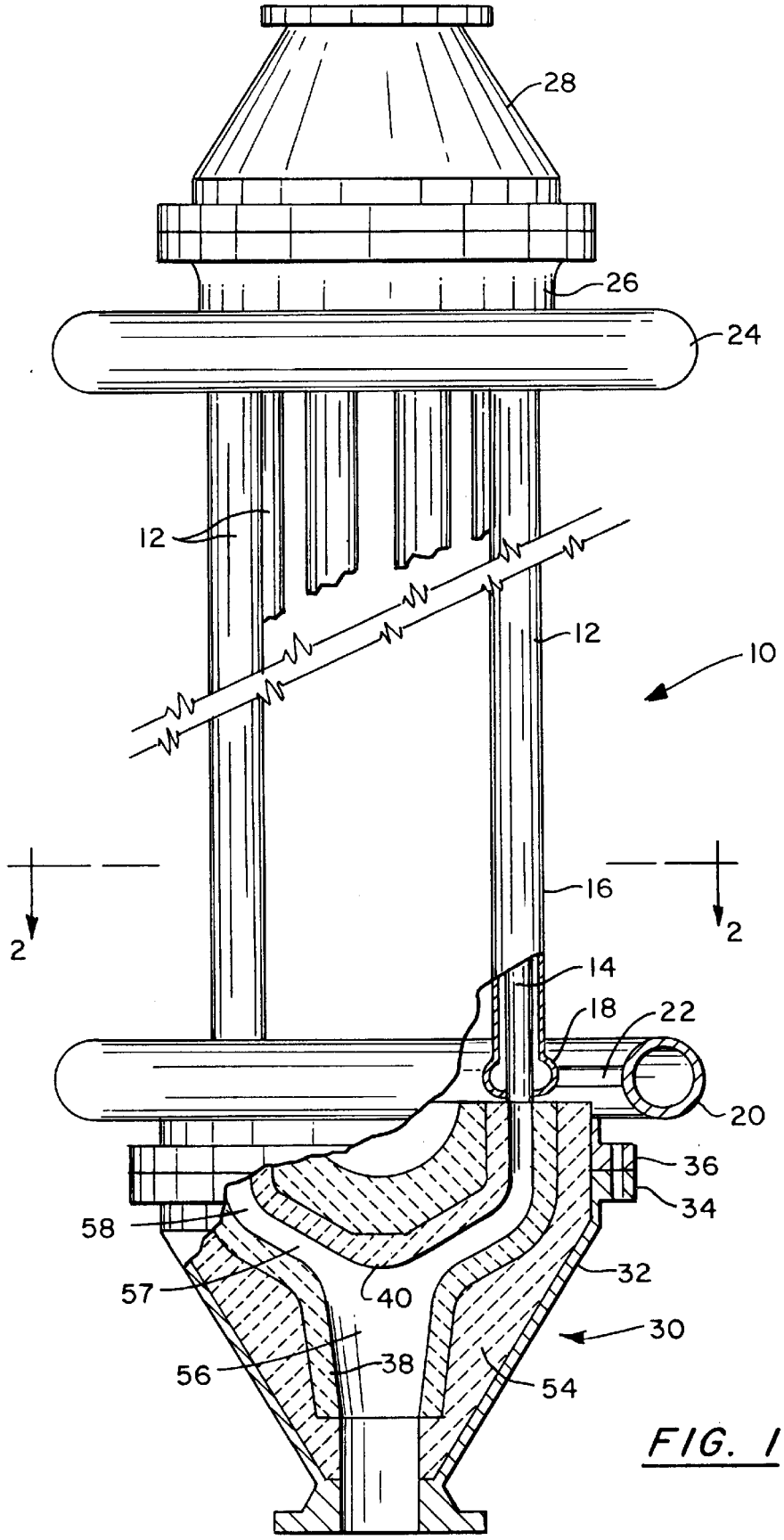
FIG. 1 shows a side elevation view of a quench cooler partially in cross-section incorporating the present invention.

Referring to FIG. 1, the quench cooler 10 comprises a plurality of double tube heat exchange elements 12 which in turn comprise the inner tubes 14 which carry the cracking furnace effluent gas surrounded by the outer tubes 16. The annulus between the two tubes carries the coolant water/steam mixture. The lower ends of the tubes 14 and 16 are connected to the oval header 18 while the upper ends are connected to a similar oval header.

Figure 3:
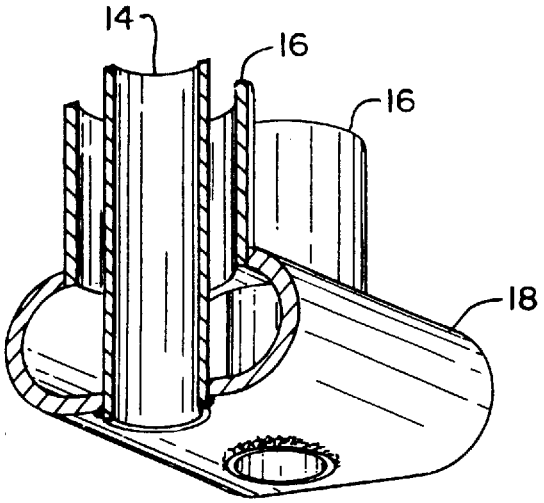
FIG. 3 is a perspective view of the connection of the tubes to and through the oval header.

The connection of the tubes to the oval headers is shown in detail in FIG. 3. The inner tubes 14 pass completely through the header while the outer tubes 16 terminate at the header and are open to the inside of the header. Cooling water, which is supplied to the lower header 18 via the coolant inlet header 20 and the radial coolant tubes 22, as shown in FIG. 1, flows through the lower header 18, into the annular space between the tubes and upwardly emptying into the upper header. The coolant, which is now a heated steam/water mixture, flows out from the upper header into the coolant outlet header 24. The cooled gas which is flowing up through the pipes 14, empties into the upper outlet chamber 26 and is discharged through the outlet 28.

Figure 2:
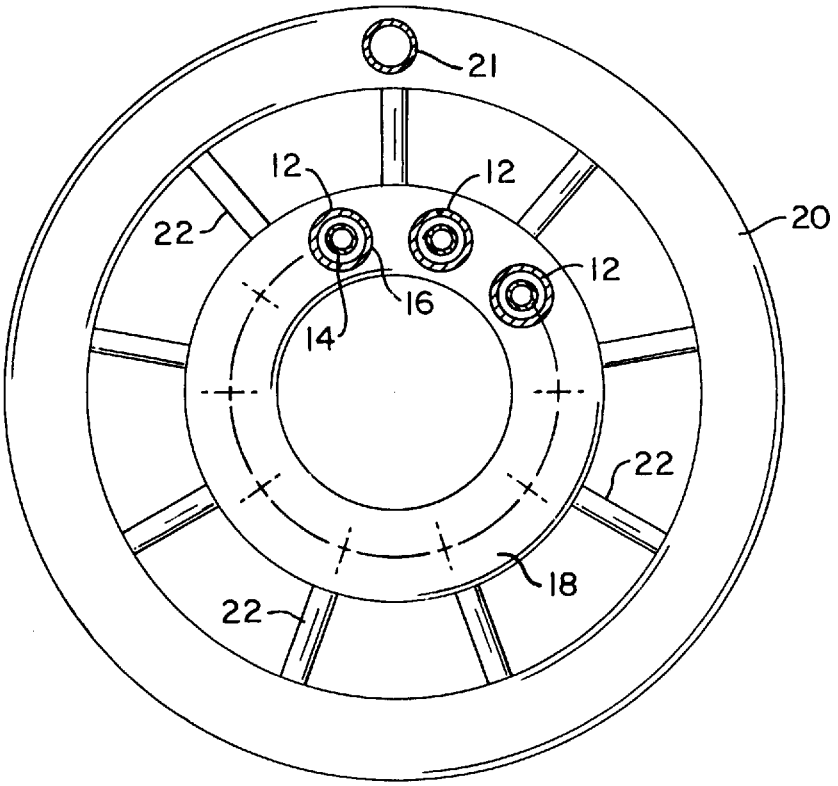
FIG. 2 is a cross-sectional view of the quench cooler of FIG. 1 taken along line 2—2.

The present invention is illustrated using an 18-tube arrangement which is best seen in FIG. 2. This figure shows the annular oval header 18 to which the elements 12 are connected. A plurality of the water inlet connections 22 are shown extending between the header 20 and the header 18. The water inlet to the header 20 is shown at 21.

The quench cooler of the present invention can be applied most advantageously with cracking furnaces (not illustrated) employing a relatively small number of high capacity cracking coils. For example, such a furnace might have six coils each 12 meters (40 feet) in height with each coil formed from a multiplicity of inlet tubes feeding into a single 16.5 cm (6.5 in.) internal diameter outlet tube. The effluent from one such coil can be quenched in a single quench cooler of the present invention. The quench cooler typically has sixteen or more quencher tubes.

The connecter 30 at the lower end of the quench cooler comprises a container 32 which forms the pressure boundary. A flange 34 around the edge of the container 32 is attached to the flange 36. The container 32 houses the components of the present invention which distribute the gases to the circular arrangement of tubes 14 and which provides the diffuser channels to decelerate and then accelerate the gases.

Figure 5:
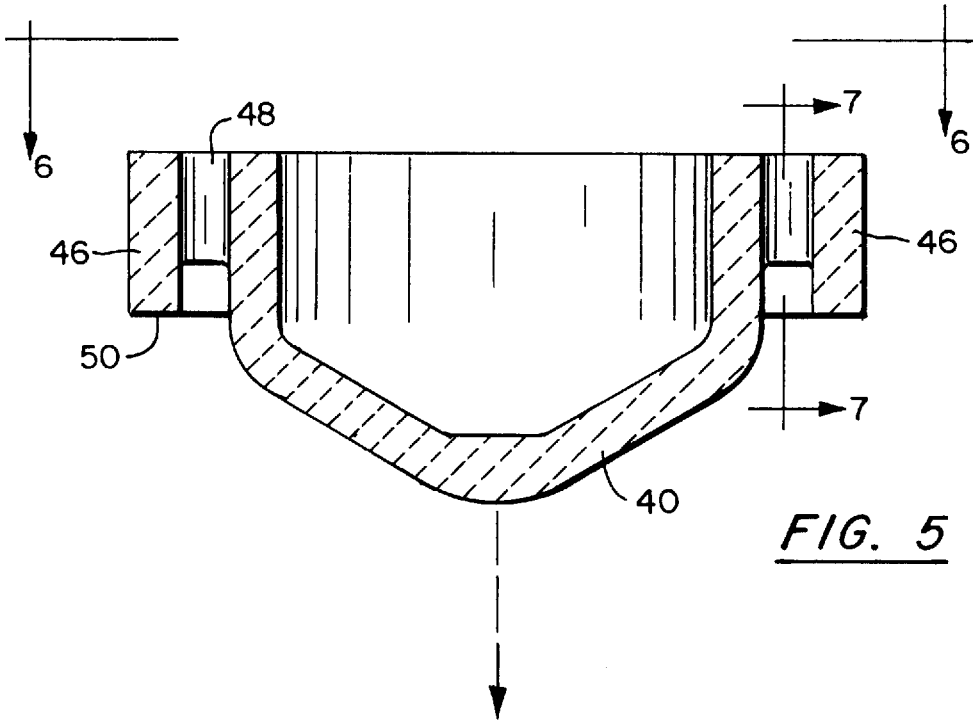
FIG. 5 is a cross-section view of the inner section of the connector.
Figure 4:
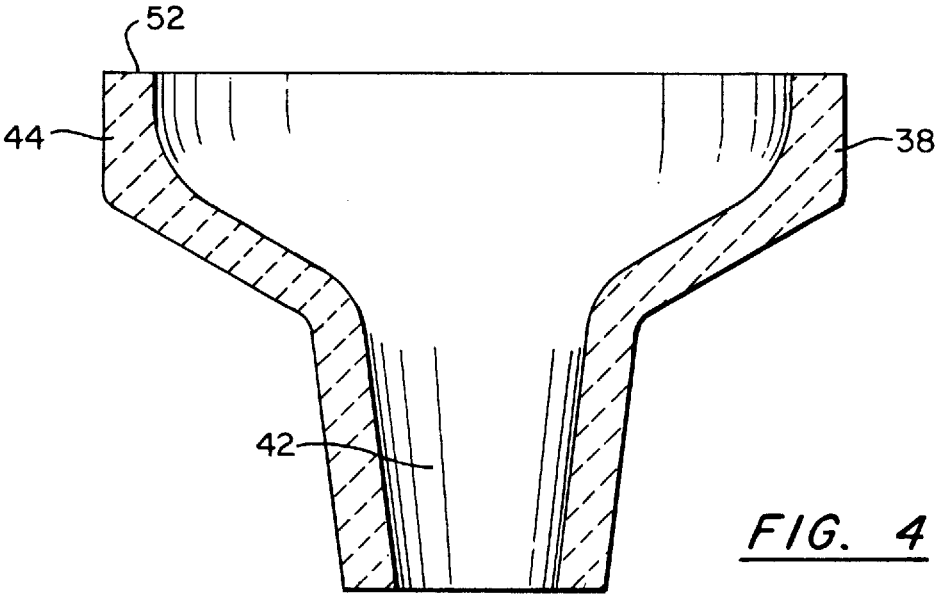
FIG. 4 is a cross-section view of the outer section of the connector.

Inside of the container are the two sections 38 and 40 which cooperate to form the flow channels. These sections are shown in more detail in FIGS. 4 and 5. The lower portion of outside section 38 comprises an outwardly tapered conical diffuser region 42 such that the flow area increases and such that the upwardly flowing gases decelerate. The upper portion 44 of the section 38 cooperates with the section 40 to provide radial diffuser and accelerator regions. As shown in FIG. 1, the section 40 is mounted on and extends down inside of the section 38 so as to form the flow passages. The sections 38 and 40 are preferably formed from a hard ceramic such as fired alumina but could also be formed from other materials such as high alloy metal castings.

Figure 6:
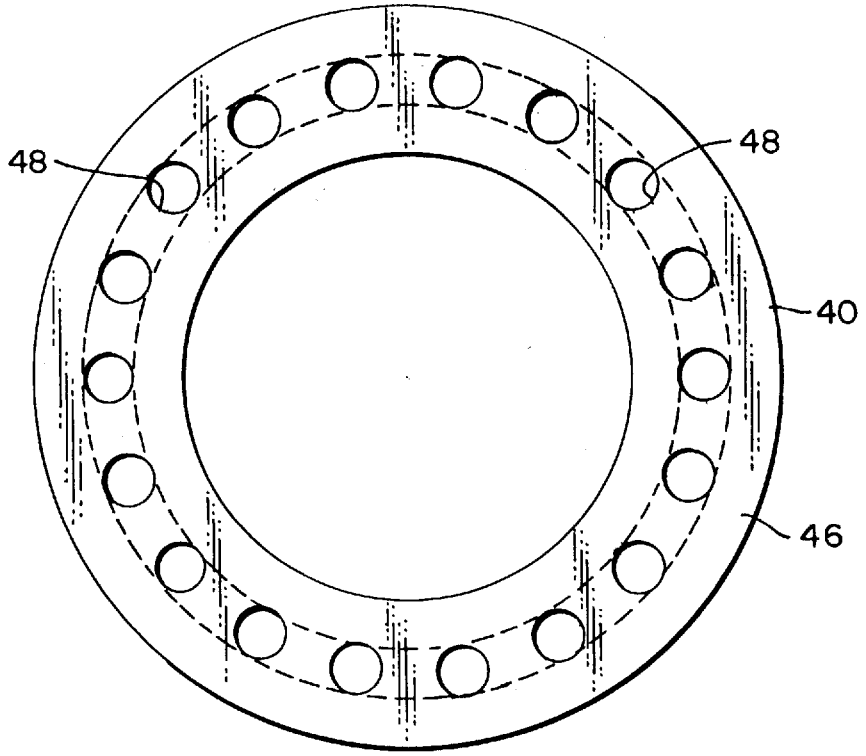
FIG. 6 is a top view of the inner section of the connector taken along line 6—6 of FIG. 5.
Figure 7:
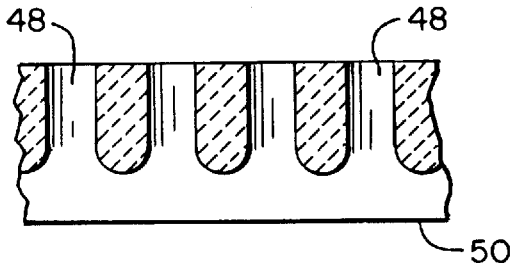
FIG. 7 is a vertical cross-section view of a portion of the connector section of FIG. 5 taken along line 7—7.

Located around the periphery of the section 40 is an annular ring portion 46. As shown in FIG. 6 which is a top view of the section 40, a plurality of holes 48 extend through this ring portion 46, one hole 48 for each tube 14. The holes 48 are located so as to be aligned with the tubes 14. The lower, outside surface 50 of the ring portion 46 engages the upper surface 52 of the section 38. There is a soft gasket between these two parts which allows for thermal expansion. There is no gasket between the connector and the tubes 14.

The two sections 38 and 40 are located in the container 32 as shown in FIG. 1 and then surrounded by the insulating castable refractory material 54 which fills the space between the sections 38 and 40 and the container 32.

When the connector is assembled as shown in FIG. 1, the gas passage comprises a diverging conical diffuser portion 56 followed by a radial diffuser section 57 which further increases the flow area. Although the height of the radial cross-sectional area of the radial diffuser section may not increase very much and in fact may decrease slightly, the circumferential cross-sectional area increases as the section extends out from the center because of the increased circumference. These diffuser portions 56 and 57 are then followed by a converging portion 58. The net effect is a smooth or monotonic convergence of the flow area. Discontinuities are avoided which would create eddies and coking. Therefore, the gases are first decelerated in the conical diffuser 56 and the radial diffuser 57 and then re-accelerated back up to the quencher tube velocity in the annular converging portion 58. The smooth re-acceleration serves to avoid flow separation thereby minimizing coke formation in dead zones while providing a uniform flow distribution to the individual quencher tubes. As a specific example, the inside diameter of the inlet tube may be 16.5 cm (6.5 in.) and the inside diameter of the outlet of the diffuser may be 22.0 cm (8.7 in.) for a ratio of flow area of 1.78. The flow area then increases further in the radial diffuser giving an overall diffuser area ratio (radial diffuser outlet to conical diffuser inlet of 4.9. The flow area then decreases as the gas accelerates into the annulus upstream of the tubes. A typical exchanger would have 18 tubes with an inside diameter of 4.8 cm (1.9 in.) giving a flow area 32 percent of that at the radial diffuser outlet.

Since the flow is re-accelerated without dead zones, coke deposition at the entrance to each tube is minimized. Even if coke is deposited in the tubes, deviation from uniform flow distribution is significantly reduced. This is the advantage of using an aerodynamically efficient diverging/converging passage instead of a conventional transfer line exchanger inlet. The result of applying the diverging/converging passage of the present invention is greatly reduced inlet residence time, uniform distribution, reduced coking tendencies and consequently improved yields and increased run length.

We claim:

1. Connecting means for feeding cracked gases from a cracking furnace coil into an annular arrangement of spaced heat exchange tubes of a quench cooler, said connecting means comprising a generally circular outer section and a generally circular inner section supported on said outer section in a manner to form a flow passage between said outer and inner sections, a portion of said outer section shaped to form a concentric, longitudinally extending, diverging conical inlet passage connected with said flow passage and wherein said flow passage comprises:

a. an annular diffuser passage connected with said inlet passage around the periphery thereof and extending radially outward therefrom and increasing in flow area in said radial extending direction, and b. an annular, longitudinally extending outlet passage connected with said annular diffuser passage around the outer radial periphery thereof adapted to feed said heat exchange tubes, said outlet passage having a configuration such that the cross sectional area decreases in the direction of flow thereby forming a generally converging outlet section.

2. Connecting means as recited in claim 1 wherein said outer and inner sections comprise a hard ceramic material.

3. Connecting means as recited in claim 1 wherein said outer and inner sections comprise a metal casting.

* * * * *